United States Patent [19]

Kahler

[11] 4,029,109

[45] June 14, 1977

[54] FLUID-COOLED SMOKING DEVICE

[76] Inventor: Richard W. Kahler, Box 61 Rte. No. 1, Rock Cave, W. Va. 26234

[22] Filed: Jan. 28, 1976

[21] Appl. No.: 653,198

[52] U.S. Cl. ..... 131/173; 131/195; 131/231

[51] Int. Cl.[2] ..... A24F 1/14; A24F 1/30

[58] Field of Search ..... 131/173, 221, 229, 194, 131/195, 231

[56] References Cited

UNITED STATES PATENTS

| | | | |
|---|---|---|---|
| 2,190,312 | 2/1940 | Cullen | 131/173 |
| 2,815,030 | 12/1957 | Wenger | 131/173 |
| 3,394,710 | 7/1968 | Chaig Ping-Rhuan | 131/173 |
| 3,872,872 | 3/1975 | Kahler | 131/173 |
| 3,881,499 | 5/1975 | McFadden et al. | 131/173 |

*Primary Examiner*—Stephen C. Pellegrino
*Attorney, Agent, or Firm*—Schwartz & Weinrieb

[57] ABSTRACT

A fluid-cooled smoking device includes a plurality of concentrically disposed tubular members which, depending upon the predetermined length of some of such members, and/or the provision of apertures therewithin, together define an elongated serpentine fluid flow path. An ash receptacle is defined within the upstream portion of the fluid flow path while the downstream portion of the flow path includes a liquid chamber, and in this manner, the smoke is air-cooled within the upstream portion of the flow path, ash deposits are segregated from the fluid flow prior to the same being further cooled within the water chamber, and consequently, the water chamber does not readily become contaminated.

29 Claims, 5 Drawing Figures

FLUID-COOLED SMOKING DEVICE

BACKGROUND OF THE INVENTION

1. Field of the Invention

The present invention relates generally to smoking devices, and more particularly to an improved fluid-cooled smoking device which is portable, readily adaptable for cleaning purposes and the removal of ash deposits therefrom, and is particularly useful in connection with the smoking of rare and expensive smoking tobaccos, improved filter ability of the same also being provided.

2. Description of the Prior Art

While smoking devices, particularly those useful for the smoking of rare and expensive tobaccos, are of course known, a particular endeavor of current or recent prior art smoking devices has been to temper the smoke or fumes inhaled by the smoker in view of the fact that such tobaccos can normally be harsh, hot, and quite irritating to the lungs of the smoker. Water pipes have become exceedingly popular as one means utilized for tempering the smoke generated in connection with the smoking of such tobaccos, such pipes normally including a water or liquid chamber interposed between the bowl, within which the tobaccos to be smoked are deposited, and the mouthpiece utilized by the smoker for inhaling the smoke or fumes. In this manner, as the smoke passes through the water liquid chamber, the same is cleaned of ash and other contaminants, as well as cooled, whereby the adverse effects of the smoke are considerably mitigated and the smoking experience tends to be quite enjoyable as desired.

A primary disadvantage of such prior art water pipes, however, is the fact that as the water or liquid chamber is the primary structure utilized for cleansing the smoke and fumes of ash and other contaminants, the water of other liquid becomes contaminated with ashes within a relatively short period of time and consequently must be changed frequently. In addition, it has been found that although such prior art devices employ a water chamber for the purpose of cooling the smoke and fumes, the volume of such chamber, as well as the flow path defined therein through which the smoke and fumes must travel, is too small for efficiently cooling the smoke and fumes to an acceptable level and consequently, despite such alleged water cooling structure, the smoke and fumes inhaled by the smoker remain insufficiently cooled.

OBJECTS OF THE INVENTION

Accordingly, it is a significant object of the present invention to provide a new and improved fluid-cooled smoking device.

Another principal object of the present invention is to provide a new and improved fluid-cooled smoking device which effectively overcomes the disadvantageous characteristic of the prior art devices.

Still another object of the present invention is to provide a new and improved fluid-cooled smoking device which will effectively cool the smoke and fumes to be inhaled to acceptable and desirable levels.

A still further object of the present invention is to provide a new and improved fluid-cooled smoking device which will effectively prevent the liquid cooling chamber from becoming contaminated and therefore obviate the necessity of frequenctly changing the coolant fluid therein.

Still another object of the present invention is to provide a new and improved fluid-cooled smoking device wherein an ash and residue chamber is provided separately and independently of the liquid coolant chamber.

A further object of the present invention is to provide a new and improved fluid-cooled smoking device wherein the residue chamber has readily accessible means for cleaning the same whereby easy cleaning of the device is facilitated.

Yet a further object of the present invention is to provide a new and improved fluid-cooled smoking device which is sturdy and rugged in its construction.

A yet further object of the present invention is to provide a new and improved fluid-cooled smoking device which is uniquely well-suited for the purpose of smoking rare and expensive tobaccos.

A yet still further object of the present invention is to provide a new and improved fluid-cooled smoking device which is readily portable and readily adaptable to efficient shipment in bulk.

A still yet further object of the present invention is to provide a new and improved fluid-cooled smoking device which may be rendered water-tight for shipment purposes.

BRIEF SUMMARY OF THE INVENTION

The foregoing and other objectives are achieved in accordance with the present invention through the provision of a fluid-cooled smoking device which includes a plurality of concentrically disposed tubular members which, depending upon the predetermined length of some of such members, or the provision of apertures therewithin, together define an elongated, serpentine fluid flow path. An ash receptacle means is defined within the upstream portion of the fluid flow path while the downstream portion of the flow path includes a water chamber, and in this manner, the smoke is air-cooled within the upstream portion of the flow path. Ash deposits are segregated from the fluid flow prior to the same being further cooled within the water chamber, and consequently, the water chamber does not readily become contaminated.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
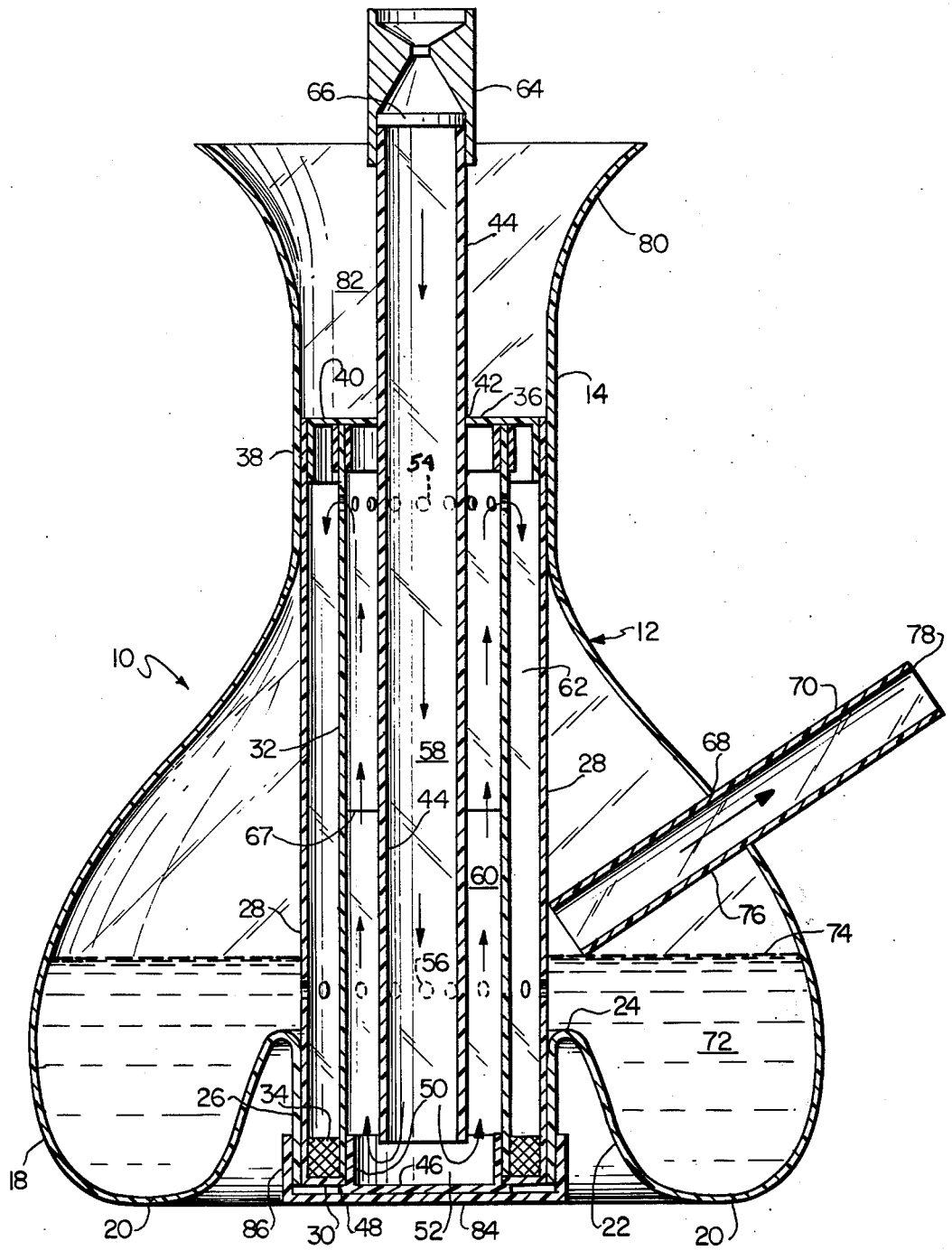
FIG. 1 is a cross-sectional view of one embodiment of a fluid-cooled smoking device constructed in accordance with the present invention and showing its cooperative parts.

Referring now to the drawings, and more particularly to FIG. 1 thereof, there is shown a preferred embodiment of a fluid-cooled smoking device, constructed in accordance with the present invention and generally indicated by the reference character 10, which includes a flask-type housing 12 having an upper, narrow neck portion 14 and a lower liquid container portion 16 integrally formed therewith, the diametrical extent of the lower portion 16 being substantially greater than that of upper portion 14. The base 18 of lower portion 16 has an annular configuration and is substantially arcuate in cross-section, however, the same includes a substantially flattened portion 20 as well as upwardly projecting portion 22, and a reversely bent or turn-downed portion 24 which serves to define a dependent neck portion 26 which is co-axially disposed with respect to neck portion 14.

A first tubular member 28 is co-axially disposed within housing 12 and has both ends thereof fixedly secured within the respective neck portions 14 and 26, the diametrical extent of tube 28 being substantially the same as that of neck portions 14 and 26 so as to facilitate a friction or threaded fit therewith. The bottom end portion of tube 28 has integrally formed therewith a radially inwardly projecting flanged portion 30, and a second tube 32, concentrically disposed interiorly of tube 28, is supported upon the radially innermost portion of flange 30, an annular, resilient seal member 34 being interposed between the lower end portions of tubes 28 and 32 so as to render such structure fluid-tight.

The upper ends of tubes 28 and 32 are similarly fixed in a fluid-tight manner, within the device by means of a substantially annular, cup-shaped cap 36, the outer diametrical extend of which is such as to fixedly secure the upper end of tube 28 between the dependent circumferential wall portion 38 of cap 36 and the inner wall surface of neck portion 14, cap 36 also including a dependent, annular, slotted partition 40, concentrically disposed interiorly of wall portion 38, which is adapted to engage and accommodate the upper end of inner tube 32. Cap 36 is further provided with a central bore 42, and a third tube 44, open at both ends thereof, is fixedly disposed within bore 42 so as to be coaxially disposed within housing 12 and concentrically disposed interiorly of second tube 32.

It should be noted that while tube 28 has been dsiclosed as being fixedly secured within neck portions 14 and 26 of housing 12 by means of a friction fitting, and similarly with respect to the disposition of tubes 32 and 44 with respect to cap 36, threaded fittings might likewise be employed. A cup-shaped cap 46 is similarly disposed within the bottom portion of second tube 32, a flanged portion 48 of cap 46 engaging the underside portion of flange 30 at the radially innermost portion thereof while an upstanding wall portion 50 frictionally or threadedly engages the interior wall portion of tube 32, and it will also be seen that the lower, open end of tube 44 is spaced above cap 46 so as to define therewith a fluid passageway 52.

A plurality of apertures 54 are provided within the upper portion of second tube 32 and are circumferentially disposed thereabout, and a plurality of apertures 56 are similarly provided within the lower portion of tube 28. In this manner, a substantially serpentine fluid passageway is defined within the device 10 by means of an axial passageway 58 defined within tubular member 44, passageway 52, an annular passageway 60 defined between tubular members 44 and 32, apertures 54, and an annular passageway 62 defined between tubular members 32 and 28, the fluid flow ultimately exiting into container 16 through means of apertures 56.

A smoking bowl 64, which may be a non-reversible bowl or a reversible-type bowl as disclosed within applicant's U.S. Pat. Nos. 3,872,872 and 3,863,646, the structure, purposes and use of the same being incorporated herein by reference, is removably disposed upon the upper end of tube 44 and may include therein a filter medium 66 removably supported upon the upper end face of tube 44, the structure and merits of filter 66 being disclosed within applicant's co-pending application Ser. No. 601,286, filed Aug. 4, 1975, In order to enhance the filterability of the system still further, an auxiliary filter 67 having an annular, disc-shaped configuration, may be fixedly interposed between tubes 32 and 44 within annular passageway 60. An aperture 68 is provided within a sidewall portion of container 16 and another tubular member 70 open at both ends thereof, is either removably disposed therein by means of a friction or threaded fitting or alternatively may be integrally formed with, or secured within, container 16, such that the lower end thereof projects interiorly of container 16. It is preferable to have tube 70 removably disposed therein for such structure thereby facilitating portability of the device, whereupon removal of tube 70, such as, for example, for shipment purposes, a plug, now shown, may be disposed within bore 68 so as to maintain the device fluid tight.

In using the smoking device of the present invention, water or other liquid material, e.g., wine, 72 is initially deposited within container 16 such that the liquid level 74 is below the lower open end 76 of tube 70, yet above the level of apertures 56, and upon depositing a desired amount of tobacco preferably within either end of a reversible smoking bowl 64, as disclosed within applicant's U.S. Patents noted hereinabove, smoke may be drawn through the device 10 as a result of the inhalation of a smoker who has placed his mouth upon the upper open end 78 of tube 70. Filter 66 will serve to retain large-sized particles of burnt tobacco, however, any other tobacco particles or ash entrained within the smoke passing through filter 66 and downwardly through fluid passageway 58 will tend to become deposited upon the interior surfaces of cap 46 which therefore serves as an ash receptacle, it being of course appreciated that as tube 44 is movably disposed within cap 36, the lower open end of tube 44 may be sufficiently spaced above cap 46 so as to maintain passageway 52 properly defined within the device irrespective of the accumulation of ash deposits within cap 46.

After traversing passageway 52, the smoke continues upwardly through annular passageway 60, and upon exiting from apertures 54 circumferentially disposed about the upper portion of tube 32, continues downwardly through annular passageway 62. As passageway 62 is fluidically connected to container 16 through means of apertures 56, water 72 is also present within the lower portion of passageway 62, and consequently, as the smoke passes downwardly through passageway 62, it enters water 72. The smoke then passes through the apertures 56 in a circumferential manner so as to enter the main body of water 72 disposed within container 16 and upon reaching water level 74, the smoke may leave water 74 and enter tube 70 so as to be inhaled by the smoker.

It will thus be apparent from the foregoing that through means of the particular disposition of tubes 28, 32 and 44, as well as apertures 54 and 56, a serpentine fluid passageway has been defined within the smoking device 10. The serpentine passageway substantially elongates the path over which the smoke is caused to travel from the smoking bowl 64 to the open end 78 of tube 70 and to the smoker and in this manner, cooling of the smoke is effectively facilitated. More particularly, the smoke, during passage through passageways 58, 60 and the upstream portion of passageway 62 is, in effect, air-cooled and subsequently, during passage through the downstream portion of passageway 62 and container 16, is water-cooled. Still further, the structural arrangement of the tubes also serves to provide an ash depository within the upstream portion of the serpentine passageway and in this manner, the smoke reaching the water chamber is already cleansed whereby the water 72 will remain clean and non-contaminated for long periods of time which effectively obviates changing the same.

It will be further noted that the upper neck portion 14 of the device 10 extends a considerable distance above the axial position of cap 36 so that the upper portion 80 of neck 14 is radially divergent. In this manner, neck 14, together with tube 44, define an annular compartment 82 within which a supply of tobacco may be stored tor use within smoking bowl 64, divergent portion 80 serving to facilitate access of the compartment.

It will also be appreciated that in accordance with the disclosed embodiment an auxiliary cup-shaped cap 84 may be disposed within the bottom portion of the apparatus or device 10, and such cap may serve several purposes. As is apparent from the FIGURE, the upstanding circumferential wall portion 86 thereof frictionally or threadedly engages the outer peripheral surface of dependent neck portion 26, and when so arranged, may serve as an ash receptacle in lieu of utilizing cap 46. If, alternatively, cap 46 is also utilized, the central portion of cap 84 will abut the underside surface of cap 46 and in this manner insure that cap 46 will be retained within the device for collection of the ash deposits, cap 84 thereby serving as a failsafe mechanism. Still further, under the latter conditions, the undersurface of cap 84 is substantially co-planar with the substantially flattened portion 20 of container 16, and in this manner, stability of the device 10 is enhanced.

Figure 2:
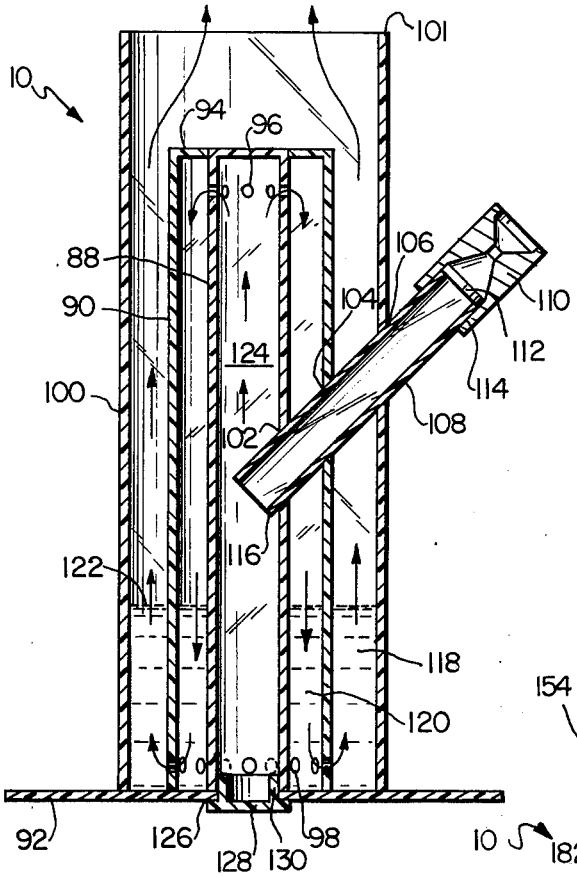
FIG. 2 is a view similar to that of FIG. 1, illustrating another embodiment of a fluid-cooled smoking device constructed in accordance with the present invention.

Referring now to FIG. 2, a second embodiment of the present invention is disclosed, such embodiment being somewhat simpler in construction than that of the first embodiment in that housing 12 has been, in effect, eliminated. In accordance with the embodiment of FIG. 2, inner and outer concentric tubular members 88 and 90 have their lower ends respectively fixedly secured and integrally with a witha planar base plate 92 which may have a circular, square, rectangular or other configuration, while the upper ends of tubes 88 and 90 are similarly connected to a plate-type cap member 94. A plurality of apertures 96 are provided within the upper portion of tube 88 and disposed circumferentially thereabout, and similarly, a plurality of apertures 98 are provided within the lower portion of tube 90.

A third tubular housing member 100 is concentrically disposed about tubes 88 and 90 and it is seen that the lower end of tube 100 is fixedly secured to plate 92 in a manner similar to the fixation of tubes 88 and 90 thereto, however, the upper end 101 of tube 100 is open. Tubes 88, 90 and 100 are further respectively provided with apertures 102, 104 and 106, which are arranged within the respective tubes, at predetermined height levels above plate 92 so as to, in effect, define a single bore, the axis of which is inclined upwardly as one proceeds in the radially outwardly direction, within which a tube 108, open at both ends, is disposed. A smoking bowl 110, having a filter 112 disposed therein, is disposed upon the upper end 114 of tube 108, and the lower end 116 of tube 108 is seen to project interiorly of central tube 88. Tube 108 may, of course, be removably or fixedly disposed within tubes 88, 90 and 100, and if removably disposed, the same may be accomplished by means of, for example, a friction fitting whereby the interfaces therebetween provide a fluid-tight fitting.

In using the device of the second embodiment, water is initially deposited within the lower portion of an annular chamber 118 defined between tubes 90 and 100, and as the apertures 98 fluidically connect chamber 118 with a similar chamber 120 defined between tubes 88 and 90, water likewise enters the latter chamber, the water level being indicated at 122. Tobacco is then deposited within bowl 110, and subsequently, the smoker places his mouth upon the open end 101 of tube 100. Upon inhaling, smoke will be drawn from bowl 110 and through filter 112 and will traverse tube 108 so as to enter the central fluid passageway 124, defined within tube 88, through means of open end 116 of tube 108.

It is also apparent from the FIGURE that bast plate 92 has been provided with a central aperture 126 havind a diametrical extent substantially equal to the inside diameter of tube 88, and a plug or cap 128 may be removably disposed within aperture 126, the upstanding circumferential wall portion 130 thereof frictionally or threadedly engaging the lower interior wall portion of tube 88. In this manner, cap 128 serves to define, along with the lower portion of tube 88, an ash receptacle for accumulating any ash deposits which may be entrained within the smoke entering passageway 124 from tube 108.

After entering passageway 124, the smoke will pass upwardly therewithin and exit therefrom through means of apertures 96 so as to subsequently pass downwardly within annular chamber 120. As noted heretofore, the lower portion of chamber 120 has water deposited therein, and consequently, upon entering the same, the smoke is cooled to a considerable degree. The smoke ultimately passes through apertures 98 and enters annular passageway 118, and upon traversing the water disposed within the latter chamber, and upon reaching water level 122, the smoke continues upwardly within chamber 118 so as to eventually pass out of the upper end 101 of tube 100 and into the smoker's mouth.

It will thus be apparent, as was the case with the first embodiment of the present invention, that as the smoke traverses the serpentine path, and more particularly, the serpentine loops thereof within which the water is disposed, the smoke is cooled a considerable amount whereby the harsh and irritating effects thereof are substantially negatived. In addition, it should also be appreciated that due to the provision of the apertures 96 and 98, as well as tubes 88, 90 and 100, the smoke is dispersed through a greater volume of water than currently achieved with prior art devices, and consequently, the cooling of the same is more effective.

Figure 3:
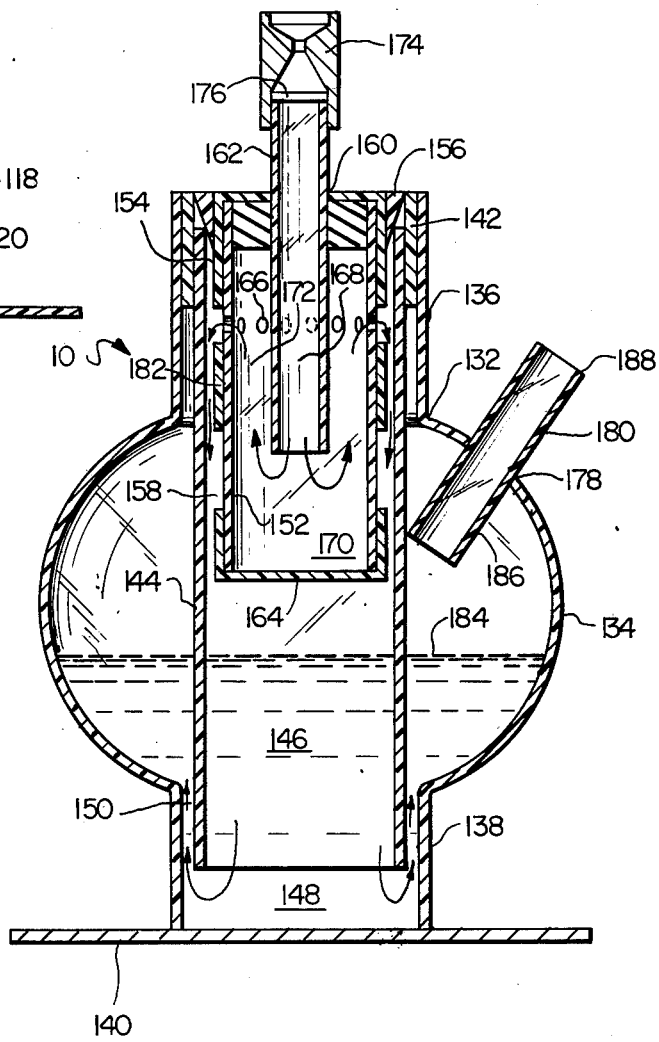
FIG. 3 is a view similar to that of FIG. 1, illustrating still another embodiment of a fluid-cooled smoking device constructed in accordance with the present invention.

With particular reference now being made to FIG. 3, a third embodiment of the present invention is disclosed wherein the device 10 is seen to include a one-piece flask-type housing 132 which comprises preferably a substantially spherical central portion 134 and upper and lower tubular sections 136 and 138, respectively, of diametrical extents substantially smaller than that of spherical section 134. The bottom portion of tubular section 138 is integrally secured to a plate-type base 140, and the upper end of section 136 is open. An annular spacer 142 is fixedly secured to the inner peripheral surface of the upper portion of section 136 and a tubular member 144 open at both ends is similarly secured, at the upper portion thereof, to the inner peripheral surface of spacer 142 so as to depend therefrom, the lower end of member 144 being spaced above base plate 140. As the diametrical extents of sections 136 and 138 are substantially equal, spacer member 142 serves to support the lower end of tube 144 in concentric fashion with respect to section 138 of housing 132, and in this manner, a continuous fluid passageway is defined within the device and is seen to include a central passageway 146 defined within tube 144, a chamber 148 defined between the outer peripheral surface of the lower end of tube 144 and section 138. The continuous fluid passageway as illustrated herein is essentially the same type of passageway formed with apertures 56 in FIG. 1. Thus, the embodiment illustrated in FIG. 1 can be modified in accordance with the teaching of this embodiment of the invention whereby a similar continuous fluid passageway is formed without utilizing apertures. The embodiment illustrated in FIG. 2 can similarly be modified with a passageway substituted for apertures 96 and/or 98, said passageway being formed by having either tube 88 or 90 having an open end at the same end where the apertures would have been placed.

Another tubular member 152, open at both ends thereof, has a cup-shaped rubber cap 154 frictionally fitted over the upper end thereof so as to close the same, and a substantially annular, frusto-conical spacer 156 is similarly disposed externally about the upper end of cap 154. As the upper end of tube 144 is secured to spacer 142 at an axial position which is disposed below the uppermost end portion of spacer 142, when tube 152, cap 154 and spacer 156 are disposed co-axially within tube 144, spacer 156 will be seated upon and engage the uppermost end portions of tube 144 and spacer 142, and in this manner, tube 152, as well as cap 154, will be concentrically disposed within tube 144 so as to define an annular chamber 158 therebetween.

Cap 154 is provided with central aperture 160 within and through which an additional tubular member 162, open at both ends, is disposed by means of a friction fitting, and the lower end of tube 152 is additionally provided with another cup-shaped rubber cap 164. The upper portion of tube 152 is further provided with a plurality of apertures 166 disposed circumferentially thereabout, and the lower end of tube 162 is disposed above the interior end face of cap 164. In this manner a continuous fluid passageway is defined within the aforenoted structure and is seen to include a central passageway 168 defined within tube 162, a chamber 170 defined between the lower end of tube 162 and the interior end face of cap 164, an annular passageway 172 defined between tubes 162 and 152, apertures 166, and annular passageway 158. As the diametrical extent of cap 164 is substantially the same as that of cap 154, the outer peripheral surface of cap 164 is likewise spaced from the interior peripheral surface of tube 144 as a result of the support of the tubular assembly by means of spacer 156, and consequently, annular passageway 158 is likewise in fluidic communication with central passageway 146.

It is understood that a smoking bowl 174, having a filter means 176 disposed therein, is mounted upon the upper end of tube 162, and it is also apparent that the spherical portion 134 of housing 132 is provided with an aperture 178 within and through which a tube 180 is frictionally or alternatively fitted. In the instance that tube 180 is frictionally fitted, the same may be removed from housing 132, and a plug, not shown, inserted therein so as retain the device fluid-tight while the same is, for example, being transported or shipped. In addition, in order to insure the fluid-tightness of the device still further under such conditions, an axially movable, annular rubber sleeve 182 is disposed about the outer peripheral surface of tube 152 by means of a friction fitting, and when it is desired to secure the device in a fluid-tight manner, sleeve 182 may be upwardly moved so as to cover apertures 166. In this manner, the water is retained solely within housing 132 and tube 144.

In using the device of the presently described embodiment, tobacco will be deposited within bowl 174, and water will be deposited within housing 132 so as to achieve a level indicated at 184 which is below the lower end 186 of tube 180. The smoker will then place his mouth about the upper end 188 of tube 180, and upon inhaling, smoke will be drawn from bowl 174 through filter 176 and downwardly into passageway 168. Ash deposits will be accumulated upon the interior end face of cap 164, as well as within the lower end of tube 152, such structure thereby defining the ash receptacle, and subsequently, smoke will be drawn upwardly through passageway 172 so as to exit from tube 152 through means of apertures 166. The smoke then travels downwardly through passageway 158, and upon encountering the water within the lower portion of tube 144, enters the same and continues downwardly through passageway 146. The smoke continues on through the water traversing chamber 148, and ultimately enters annular passageway 150, leaves the water upon encountering the surface 184 thereof, and lastly enters tube 180 so as to be inhaled by the smoker.

It is noted that the liquid chambers illustrated in FIGS. 1 to 3 represent preferred designs. Thus, tube 100, illustrated in FIG. 2 as being cylindrical in shape, can be modified to other desirable shapes. For example, the lower end of tube 100, containing the liquid material therein, can have a fish-bowl shape, such as that illustrated in U.S. Pat. No. 3,863,646. In addition, the lower tubular portions 138 illustrated in FIG. 3 can be omitted whereby the bottom portion of substantially spherical section 134 is integrally secured to a plate-type base 140. It is also noted that the smoking pipes discussed in FIGS. 1 to 3 may contain additional concentrally disposed tubular members defining the elongated serpentine flow path although said additional members are not illustrated herein. Similarly, in each of the embodiments of this invention, more than one tube similar to tube 70, may be incorporated into the pipes of this invention.

Figure 4:
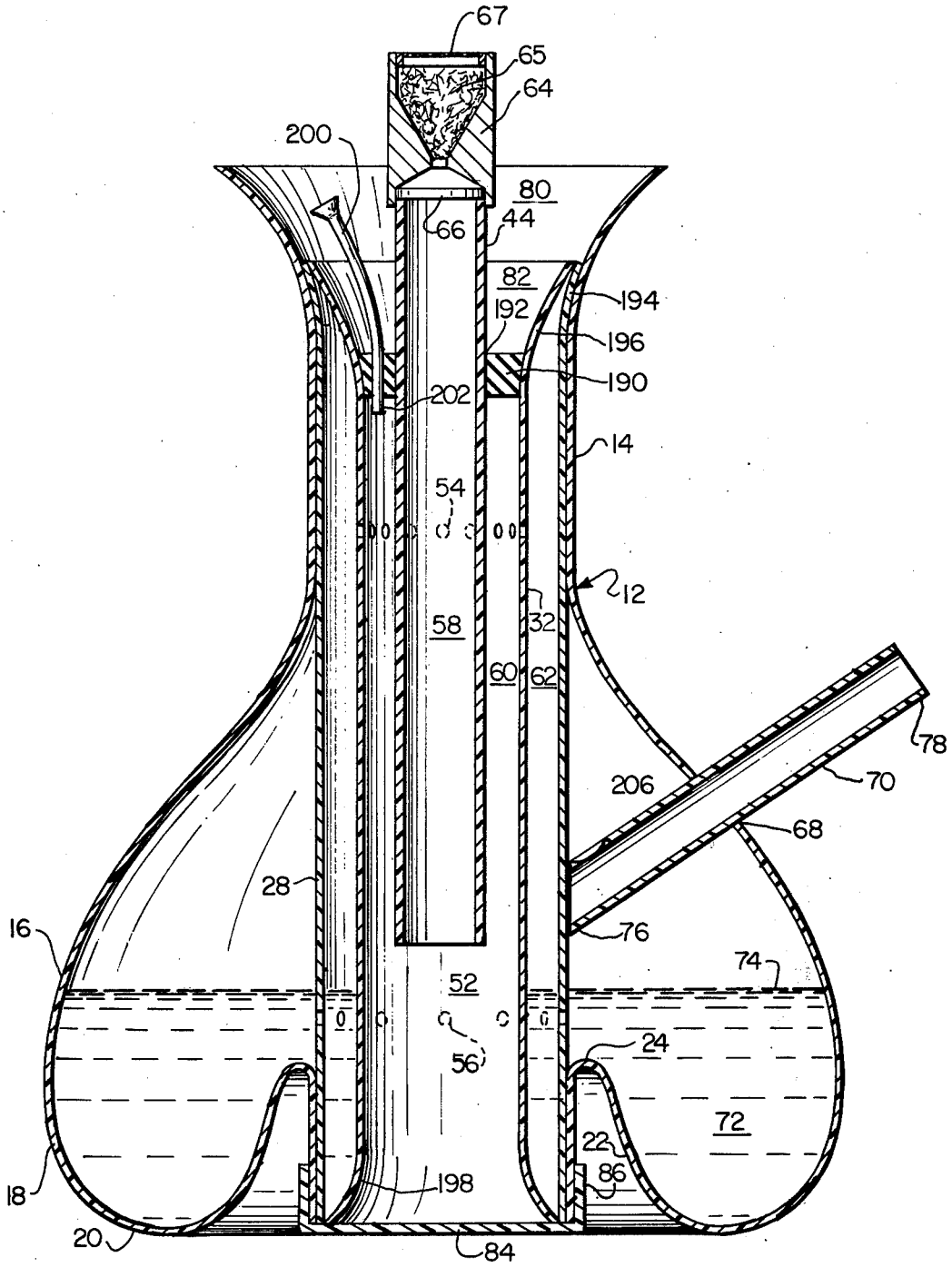
FIG. 4 is a cross-sectional view of a smoking device similar in construction to that which is illustrated in FIG. 1.

With reference now being made to FIG. 4, a modified embodiment of the apparatus disclosed within FIG. 1 is illustrated wherein it will be appreciated that partitioned cap 36 has been replaced by means of a simplified, frusto-conical cap 190 which frictionally engages the inner peripheral surface of tube 32 at the upper portion thereof and is provided with a central bore 192 within which central tube 44 is frictionally disposed. In order to fluidically seal the upper portion of annular chamber 62, the height of tube 28 is extended upwardly so as to include an upper portion 194 which is disposed adjacent to and in contact with an inner peripheral surface portion of the upper portion 80 of neck 14. Similarly, the upper portion 196 of tube 32 is likewise extended upwardly and is additionally curved in a radially divergent manner so as to contact an inner peripheral surface portion of upper portion 194 of tube 28. The upper portions 196, 194 and 80 of tubes 32 and 28, and container 16, respectively, may be glued or otherwise bonded by conventional techniques together, and it will be apparent that the upper portion 80 of container 16, as well as the upper portion 196 of tube 32, serve to define the tobacco storage chamber or compartment 82.

In a similar manner, cap 46 and seal member 34 have also been omitted within the lower portion of the apparatus, cap 84 however, being retained for performance of the ash receptacle and removal purposes. In order to fluidically seal the lower portion of annular chamber 62, the lower portion 198 of tube 32 has likewise been curved in a radially divergent manner so as to contact the lower end of tube 28 along the inner peripheral surface thereof, and in this manner, the lower ends of tubes 28 and 32 may be glued or otherwise sealed together as may also be true of the lower end of tube 28 with respect to the neck portion 26.

It is to be noted that the cap 190 may be a two-piece type cap similar to the cap utilized within the embodiment of FIG. 3 in that the same may comprise a cap portion per se similar to portion 154 thereof and a spacer similar to the spacer 156 thereof, or alternatively, may be a single-piece type cap, as disclosed within FIG. 4, the spacer portion being, in effect, integrally formed with the cap portion. In addition, an air vent tube 200, open at both ends thereof, may be fixedly disposed within cap 190 such that the lower end 202 thereof projects into the upper portion of annular chamber 62, while the upper portion 204 thereof projects upwardly into the atmosphere beyond the upper surface of cap 190. The upper open end of tube 200 is adapted to be selectively covered or uncovered by the user's finger, and in this manner, auxiliary or supplemental air may be permitted to enter, or prevented from entering, annular chamber 62 as desired in order to alter the smoking characteristics of the apparatus.

Still yet further, it is seen that the lower open end 76 of tube 70 has such a configuration that the plane, within which the aperture thereof is defined, is disposed parallel with, and closely adjacent to, an outer peripheral surface portion of tube 28 in order to prevent any splash from entering tube 70. In order to nevertheless provide for the adequate introduction of air into tube 70, however, an aperture 206 is provided within the upper portion of end 76, and in this manner, splash is again prevented from entering tube 70 while sufficient air and withdrawn smoke is able to enter the same for the smoking purposes.

According to a preferred embodiment of this invention, a screen or filter means 67 having the same design as filter means 76, may be placed over tobacco 65 located within the smoking bowl 174. Filter means 67, when used in this manner, permits the tobacco to lie compressed within the bowl 174.

Figure 5:
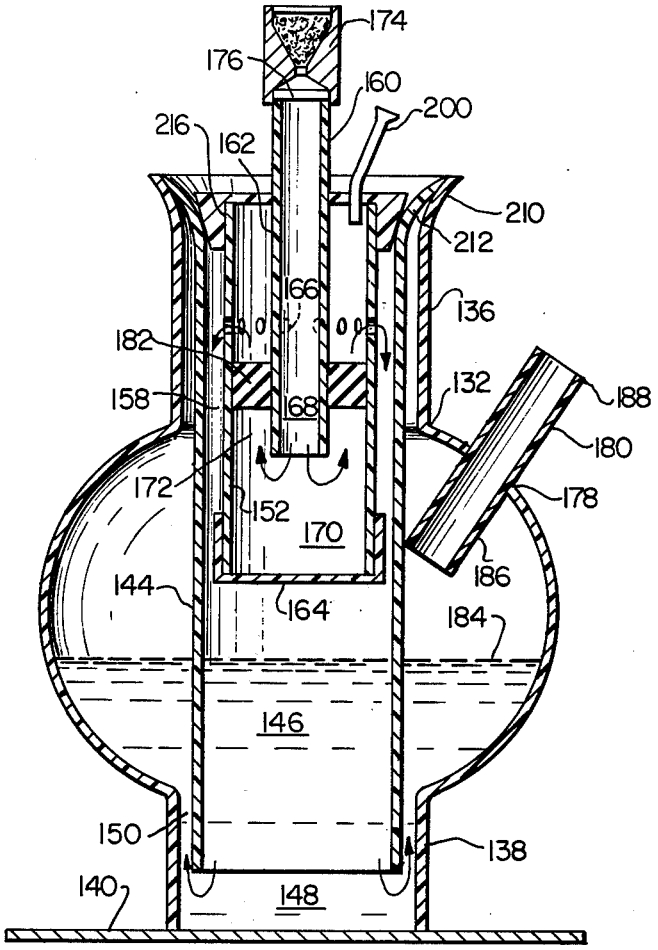
FIG. 5 is a cross-sectional view of a smoking device similar in construction to that which is illustrated in FIG. 3.

Referring now to FIG. 5, a modified embodiment of the apparatus disclosed within FIG. 3 is illustrated wherein, similar to the apparatus of FIG. 4, the sealing structure of the smoking apparatus has been considerably simplified. In accordance with such, spacer 142 has been eliminated, and the upper portions 210 and 212, respectively, of tubular members 136 and 144 have been curved in a radially divergent manner. Portion 212 is curved more sharply than portion 210 so as to contact an inner peripheral surface portion thereof, and in this manner, such structure facilitates the gluing or otherwise sealing together of such structural portions in order to fluidically seal the upper portion of housing 132.

In order to similarly fluidically seal the upper portion of tube 144, as well as annular chamber 158, a cap 214, similar in construction to cap 190 of the embodiment of FIG. 4, is frictionally disposed within the upper divergent portion 212 of tube 144, the upper end 216 of tubular member 152 being secured within cap 214 whereby tube 152 depends therefrom. It is to be noted that, in conjunction with the apertures 166 of tubular member 152, and the sleeve 182 disposed therearound for sealing the apertures 166 as desired, sleeve 182 may ordinarily be fabricated of a rubber material, but may likewise be made of a filter material so to prevent and/or further eliminate particles from entering the water or other liquid material used, during the transportation of the apparatus.

Obviously, many modifications and variations of the present invention are possible in light of the above teachings. It is to be understood therefore that within the scope of the appended claims, the present invention may be practiced otherwise than as specifically described herein.

What is claimed is:

1. A fluid-cooled smoking device comprising:

housing means for containing a volume of fluid;

means for containing a supply of tobacco to be smoked;

means operatively connected to said tobacco container means for introducing smoke into said housing;

means operatively connected to said housing and projecting outwardly therefrom for withdrawing said smoke from said housing;

means interposed between said smoke introducting means and said smoke withdrawal means, and partially disposed within said fluid for defining an elongated serpentine flow path for said smoke, whereby said smoke is cooled due to the travel of the same through said elongated path and said fluid; and ash receptacle means disposed within said serpentine flow path for accumulating ash deposits.

2. A fluid-cooled smoking device as set forth in claim 1, wherein said housing means is of the flask-type.

3. A fluid-cooled smoking device as set forth in claim 1, wherein said housing means is a cylindrical tube.

4. A fluid-cooled smoking device as set forth in claim 1, wherein said tobacco container means is a smoking bowl.

5. A fluid-cooled smoking device as set forth in claim 4, wherein said smoking bowl is a reversible smoking bowl.

6. A fluid-cooled smoking device as set forth in claim 1, wherein said smoke introducing means and said smoke withdrawal means comprise tubular members.

7. A fluid-cooled smoking device as set forth in claim 1, wherein said means defining said serpentine flow path comprises a plurality of concentrically disposed tubular members.

8. A fluid-cooled smoking device as set forth in claim 1, wherein said serpentine flow path means comprises:

a first tubular member operatively connected to said smoke introduction means at one end thereof and defining a first fluid passageway therewithin, the other end thereof being open;

a second tubular member, closed at both ends, concentrically disposed about said first tubular member, a second annular passageway being defined between said first and second tubular members, the lower end of said second member being disposed below the lower end of said first tubular member so as to define an interconnecting chamber or passageway between said first and second passageways;

a third tubular member, closed at both ends and fixedly secured to said housing, concentrically disposed about said second tubular member, a third annular passageway being defined between said second and third tubular members;

means defining a first set of apertures within said second tubular member for fluidically interconnecting said second and third annular passageways; and means defining a second set of apertures within said third tubular member for fluidically interconnecting said third annular passageway with said housing and said fluid contained therein.

9. A fluid-cooled smoking device as set forth in claim 8, further comprising air vent means interconnecting said second annular passageway with atmosphere.

10. A fluid-cooled smoking device as set forth in claim 8, further comprising splash prevention means for preventing fluid splash from entering said smoke withdrawal means.

11. A fluid-cooled smoking device as set forth in claim 8, wherein:

said smoke withdrawal means is a tubular member, the lower end of which is disposed adjacent to and parallel with the outer peripheral surface of said third tubular member; and means defining an aperture is provided within the upper portion of said lower end of said smoke withdrawal tubular member.

12. A fluid-cooled smoking device as set forth in claim 8, further comprising ash receptacle means removably secured within the lower end of said second tubular member for accumulating ash deposits.

13. A fluid-cooled smoking device as set forth in claim 12, wherein said ash receptacle means is a cup-shaped cap.

14. A fluid-cooled smoking device as set forth in claim 8, further comprising filter means disposed within said second annular passageway.

15. A fluid-cooled smoking device as set forth in claim 1, wherein said ash receptacle means is disposed upstream of said fluid.

16. A fluid-cooled smoking device as set forth in claim 15, wherein said ash receptacle means is removably disposed within said serpentine flow path.

17. A fluid-cooled smoking device as set forth in claim 1, further comprising filter means interposed between said tobacco container means and said smoke introduction means.

18. A fluid-cooled smoking device as set forth in claim 1, wherein said serpentine flow path means comprises:

a first tubular member, closed at both ends, operatively connected at an axially intermediate portion thereof with said smoke introduction means and defining a first fluid passageway therewithin;

a second tubular member, closed at both ends, concentrically disposed about said first tubular member, a second annular passageway being defined therebetween;

a third tubular member, closed at one end thereof and operatively connected to said smoke withdrawal means at the other open end thereof, concentrically disposed about said second tubular member, a third annular passageway being defined therebetween;

means defining a first set of apertures within said first tubular member for fluidically interconnecting said first and second passageways; and means defining a second set of apertures within said seecond tubular member for fluidically interconnecting said second and third annular passageways.

19. A fluid-cooled smoking device as set forth in claim 18, further comprising ash receptacle means removably secured within the lower end of said first tubular member for accumulating ash deposits.

20. A fluid-cooled smoking device as set forth in claim 19, wherein said ash receptacle means is a cup-shaped cap.

21. A fluid-cooled smoking device as set forth in claim 18, further comprising means defining aligned bores within said first, second, and third tubular members for accommodating said smoke introduction means.

22. A fluid-cooled smoking device as set forth in claim 1, wherein said serpentine flow path means comprises:

a first tubular member having one end thereof operatively connected to said smoke introduction means, the other end thereof being open, and defining a first fluid passageway therein;

a second tubular member, closed at both ends, concentrically disposed about said first tubular member, a second annular passageway being defined between said first and second tubular members, and the lower end of said second tubular member being disposed below the lower end of said first tubular member so as to define a chamber or passageway interconnecting said first and second passageways;

a third tubular member concentrically disposed about said second tubular member, a third annular passageway being defined between said second and third tubular members;

means defining a set of apertures within said second tubular member for fluidically interconnecting said second and third annular passageways.

23. A fluid-cooled device as set forth in claim 22, further comprising ash receptacle means removably secured to the lower end of said second tubular member for accumulating ash deposits.

24. A fluid-cooled smoking device as set forth in claim 23, wherein said ash receptacle means is a cup-shaped cap.

25. A fluid-cooled smoking device as set forth in claim 22, further comprising:

spacer means fixedly secured to said housing and interposed between said housing and said third tubular member for concentrically disposing said third tubular member within said housing, a fourth annular passageway being defined therebetween; and the lower end of said third tubular member is disposed above the base of said housing so as to define a chamber or passageway for fluidically interconnecting said third and fourth annular passageways.

26. A fluid-cooled smoking device as set forth in claim 22, further comprising:

sleeve means disposed about said second tubular member and axially movable thereon for covering or uncovering said apertures, whereby said device may be rendered fluid-tight as desired.

27. A fluid-cooled smoking device as set forth in claim 26, wherein said sleeve means is fabricated of filter material so as to prevent foreign particles from entering said fluid.

28. A fluid-cooled smoking device as set forth in claim 22, wherein:

the upper portion of said third tubular member is curved in a radially divergent manner so as to contact said housing and thereby concentrically disposed said third tubular member within said housing, a fourth annular passageway being defined therebetween; and the lower end of said third tubular member is disposed above the base of said housing so as to define a chamber or passageway for fluidically interconnecting said third and fourth annular passageways.

29. A fluid-cooled smoking device as set forth in claim 22, further comprising air vent means interconnecting said second annular passageway with atmosphere.

* * * * *